United States Patent [19]

Yasui et al.

[11] Patent Number: 4,667,873

[45] Date of Patent: May 26, 1987

[54] TOP OR BOTTOM SEALING STRUCTURE FOR PAPER CONTAINER

[75] Inventors: Nobushige Yasui; Muneki Fukumoto; Shinzo Saito, all of Tokyo, Japan

[73] Assignee: Jujo Paper Co., Ltd., Tokyo, Japan

[21] Appl. No.: 819,843

[22] Filed: Jan. 17, 1986

[30] Foreign Application Priority Data

Jun. 26, 1985 [JP] Japan ..... 60-96998[U]

[51] Int. Cl.[4] ..... B65D 5/08

[52] U.S. Cl. ..... 229/137; 229/17 R; 229/138

[58] Field of Search ..... 229/17 R, 17 G, 37 R, 229/44 R, 137–139

[56] References Cited

U.S. PATENT DOCUMENTS

| | | | |
|---|---|---|---|
| 2,034,594 | 3/1936 | Norris et al. | 229/37 R |
| 3,412,922 | 11/1968 | Miller et al. | 229/37 R |
| 4,113,168 | 9/1978 | Shirakawa | 229/37 R |
| 4,192,446 | 3/1980 | Naito | 229/17 G |

FOREIGN PATENT DOCUMENTS

| | | | |
|---|---|---|---|
| 2515849 | 10/1975 | Fed. Rep. of Germany | 229/37 R |
| 82/03370 | 10/1982 | PCT Int'l Appl. | 229/17 G |

*Primary Examiner*—William Price

*Assistant Examiner*—Gary E. Elkins

*Attorney, Agent, or Firm*—Parkhurst & Oliff

[57] ABSTRACT

Top or bottom structure for a paper container with a flat type top or bottom having opposed outside bottom plates formed of board paper having thermal adhesive plastic layers on both front and back surfaces and opposed inside bottom plates having folding lines of isosceles triangular shape. A first end piece (10) extending from a first outside bottom plate (6), disposed at the outermost side during assembling and shaping, extends further than other end pieces (11, 12, 13). A second end piece (12) of a second outside bottom plate (8) is formed in a tongue shape by first and second cutouts at right and left sides, which first and second cutouts are equal in depth to adjacent additional cutouts extending 2/5 of the length along the inside bottom plates. Third and fourth cutouts (26, 27) are formed on the second outside bottom plate at the right and left sides of the second end piece, and an assembling and folding line (30) is formed between the points of greatest cutting depth of said third and fourth cutouts. By this configuration, unreasonable force may be avoided during assembling and shaping, pressing and heat sealing, and bending resistance and load may be reduced in the case of thick board paper.

5 Claims, 4 Drawing Figures

TOP OR BOTTOM SEALING STRUCTURE FOR PAPER CONTAINER

BACKGROUND OF THE INVENTION

This invention relates to a top or bottom structure of a square cylindrical container formed of board paper having thermal adhesive plastic layers on both front and back surfaces.

FIG. 4 shows the construction of a conventional paper container proposed by Japanese Utility Model Publication No. 2205/1984. This square cylindrical paper container is constructed with a flat type top or bottom having opposed outside bottom plates 36 and 38 formed on board paper having thermal adhesive plastic layers on both front and back surfaces, and opposed inside bottom plates 37 and 39 having folding lines of isosceles triangular shape. End pieces extend from the respective bottom plates. The end piece 40 of the first outside bottom plate 36, which is disposed at the outermost side during the assembling and shaping time, extends further than the other end pieces 41, 42 and 43, the end piece 42 of the second outside bottom plate being cut out at the right and left ends, the end pieces 41, 43 of the inside bottom plates being cut out only 2/5 of the entire length of the end pieces at the end of the side adjacent to the second outside bottom plate, and the remaining end pieces 41, 42 and 43 being held by the inner surface of the end piece 40 of the first outside bottom plate and the outer surface of the second outside bottom plate and being thermally bonded.

The conventional paper container of the above mentioned construction has strong impregnability and is capable of holding a content for long periods of time. In this container, the end piece 42 of the second outside bottom plate is cut out at the right and left side ends, the end pieces 41 and 43 of the inside bottom plates are cut out only 2/5 of the entire length of the pieces at the end of the side adjacent to the second outside bottom plate, and the portion which does not directly contribute to the sealability is suitably cut out to provide the end pieces, thereby weakening the resistance of the bending portion and further enhancing the sealability of the opposed portions of the top of the inside bottom plates.

The construction of the abovementioned conventional paper container fundamentally provides excellent sealing, but excessive load is applied to the end piece 42 of outside bottom plate 38. More particularly, during assembling and shaping of the paper container, the outside end piece 42, the end pieces 41 and 43 of the inside bottom plates and the end piece 40 of outside bottom plate 36 are folded entirely to become flat, superposed and heat sealed. At this time, the end piece 42 is folded at 180°, the end pieces 44 and 45 of the sides having cutouts of the end pieces 41 and 43 are also similarly folded at 180° so as to be superposed on the end piece 42, and a flat bottom and top are obtained by completely folding them. However, since folding seams 46 and 47, formed when the end pieces 44 and 45 are folded, are disposed along the line of the bottom, folding line 48 of the end piece 42 is displaced slightly inwardly of the outer bottom plate 38 from the bottom line.

Therefore, when the folding line 48 of the end piece 42 is disposed on the same line as the folding seams 46 and 47, both the pressing perpendicular force for flattening the bottom and the pressing horizontal force for pressing toward the direction of the outside bottom plate 38 are applied to the end piece 42. Thus, cracks are formed at the right and left side roots of the end piece 42, thereby sometimes causing leakage of the liquid in the container.

SUMMARY OF THE INVENTION

This invention is made to advantageously provide cutouts 26 and 27 which are slightly inside from the right and left side ends to the outside bottom plate 8 at the end piece 12 formed in a tongue shape, and to further form an assembling folding line 30 for coupling between the top of the cutting depths of the cutouts 26 and 27.

The cutting depths of the cutouts 26 and 27 are deepened for a thick aluminum foil laminated layer by considering the thickness of the board paper. For example, in the case of the board paper being 0.6 to 0.7 mm thick, approx. 2 mm of cutting depth is necessary, but in the case of ordinary milk cartons which are 0.4 to 0.6 mm thick, the cutting depth may be approx. 1.5 to 1.8 mm.

Since the assembling folding line 30 is folded at 180°, it is desired to be formed thicker than an ordinary one.

In this invention, the cutouts 26 and 27 are necessary to enable folding at a position slightly inside of the outside bottom plate 8 at the end piece 12. The assembling folding seam 30 for coupling between the tops of the cutting depths of the cutouts 26 and 27 is, as apparent from the developed view of FIG. 1, not disposed on the same rectilinear line with the assembling folding seams 16 and 20 of the end pieces 23 and 24 which are folded similarly at 180°, but is disposed slightly inside. Thus, both may be superposed without unreasonable force during assembling and shaping, pressed and heat sealed.

When the assembling folding seam 30 is formed thicker, the bending resistance and the load may be reduced in case of thick board paper.

The foregoing objects and other objects as well as the characteristic features of the invention will become more fully apparent and more readily understandable by the following description and the appended claims when read in conjunction with the accompanying drawings.

DESCRIPTION OF THE PREFERRED EMBODIMENTS

Embodiments of a paper container according to this invention will now be described in detail with reference to the accompanying drawings.

Figure 1:
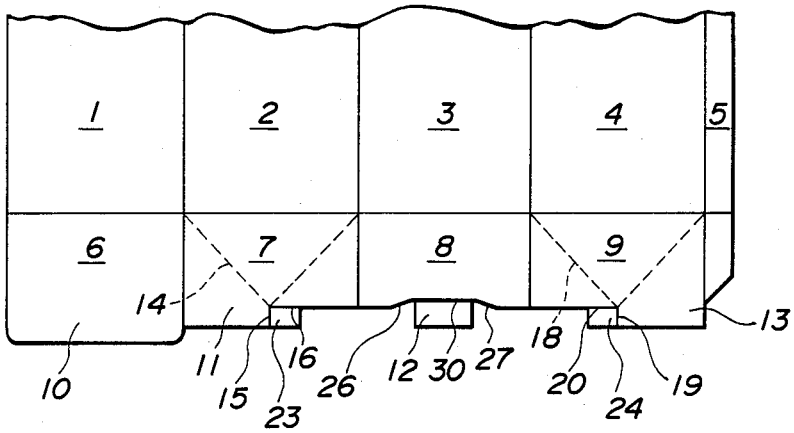
FIG. 1 is a developed view of a bottom structure of an embodiment of a paper container according to this invention as seen from the outer surface.

In FIG. 1, solid lines in a profile line designate folding lines of a crest shape, and broken lines designate folding lines of a valley shape.

Side plates 1, 2, 3, 4 and a bonding piece 5 integrated through folding lines are coupled with a top plate (not shown) for forming a top at the upper portion, and with a bottom plate for forming the bottom at the lower portion. The bottom plate is formed of a set of opposed outside bottom plates 6 and 8 and a set of opposed inside bottom plates 7 and 9. Isosceles triangular folding lines 14 and 18, having as a bottom side a boundary line between the side plates, are formed at the inside bottom plates 7 and 9 to enable folding toward the inside of the container.

Further, end pieces 10, 11, 12 and 13 are respectively integrally formed with the bottom plates 6, 7, 8, and 9. The end piece 10 formed at the first outside bottom plate 6, and disposed at the outermost side during assembling and shaping, is not folded, but is extended further than the other end pieces 11, 12 and 13. The end piece 12 formed at the second outside bottom plate 8 is cut out at both ends at the central portion in a tongue shape in a laterally symmetrical manner with respect to the center, and the end pieces 11 and 13, provided at the inside bottom plates 7 and 9, are respectively cut out at the ends of the sides adjacent to the outside bottom plate 8. These end pieces 11 and 13 have folding lines 15 and 19 integrated with the tops of the isosceles triangular folding lines 14 and 18 formed at the inside bottom plates 7 and 9, respectively, the folding lines 16 and 20 from the tops toward the outside bottom plate 8. The lengths of the cutouts of the end pieces 11 and 13 are 2/5 or less of the entire length of the end pieces.

In addition to the above construction, cutouts 26 and 27 cut inside of the second outside bottom plate 8 and are formed from the right and left side ends of the end piece 12 formed in a tongue shape, and an assembling folding seam 30 is formed on a rectilinear line for coupling between the tops of the cutting depths of the cutouts 26 and 27.

In the embodiment described above, when the end of the end piece 12 is shortened by an amount equal to the depths of cutouts 26 and 27, the end of end piece 12 is aligned with the ends of end pieces 11 and 13 when end pieces 11 and 13 are superposed. Thus, the work for pressing and heating the ends can be reliably performed. Since the folding lines 16 and 20 are folded at 180° in the same manner as the folding line 30, and strong force is applied thereto, it is therefore desirable to form lines 16 and 20 as thick as possible.

Figure 2:
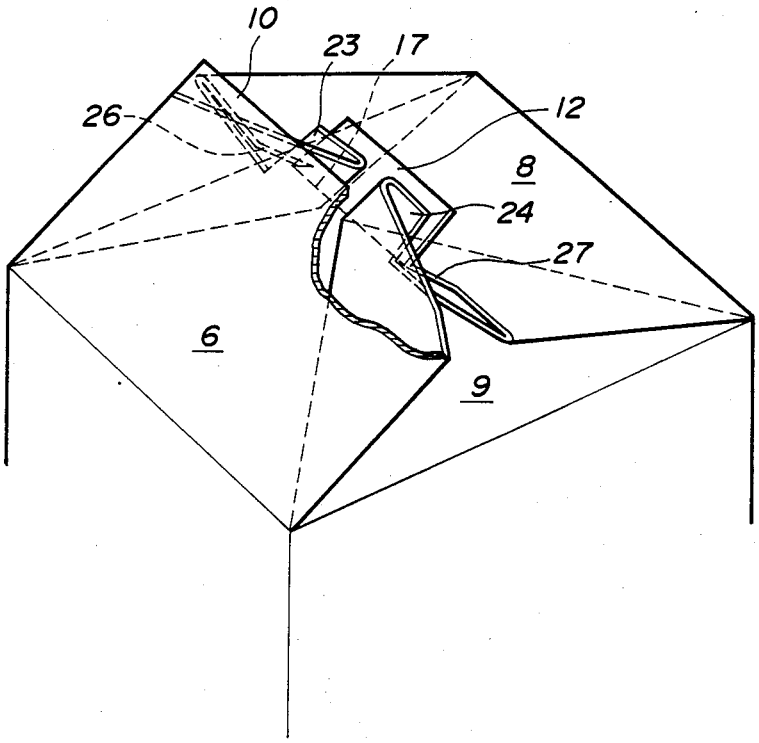
FIG. 2 is a perspective view of the container of the invention in the course of assembling.

To assemble and shape the paper container, the side plates 1, 2, 3 and 4 are first folded with respect to each other to form crests, and the bonding piece 5 is bonded to the inside of the side plate 1 to form a square cylindrical shape. As shown in FIG. 2, the inside bottom plates 7 and 9 are pressed until the folding lines 15 and 19 are bonded by utilizing the folding lines 14 and 18, and the folded end pieces 11 and 13 are held between the end pieces 10 and 12, pressed and thermally bonded from the inner and outer surfaces on the entire bottom. At this time, the end piece 12 is folded at 180° at the inside of the end pieces 11, 23, 13 and 24, but since the assembling folding line 30 is displaced from the positions of the assembling and folding lines 16 and 20, they can be assembled and shaped without unreasonable force.

It is noted that the inside of the end piece 10 is thermally bonded to the outer surface of the outside bottom plate 8. Thus, the end pieces 11, 12 and 13 are interposed between both side surfaces, and do not appear from the exterior.

Figure 3:
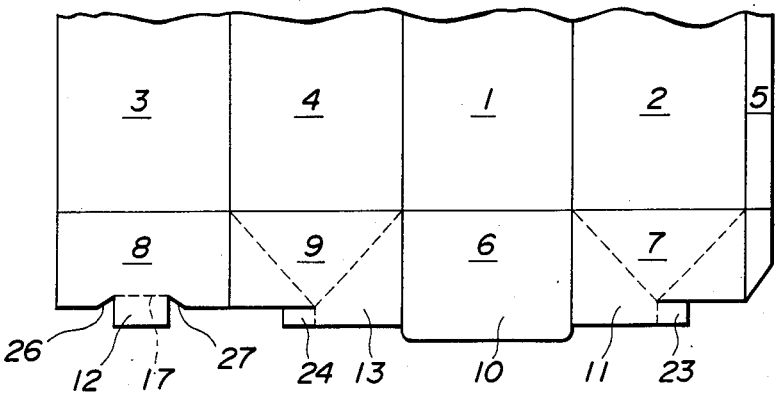
FIG. 3 is a developed view of another embodiment of a paper container according to this invention as seen from the outside.
Figure 4:
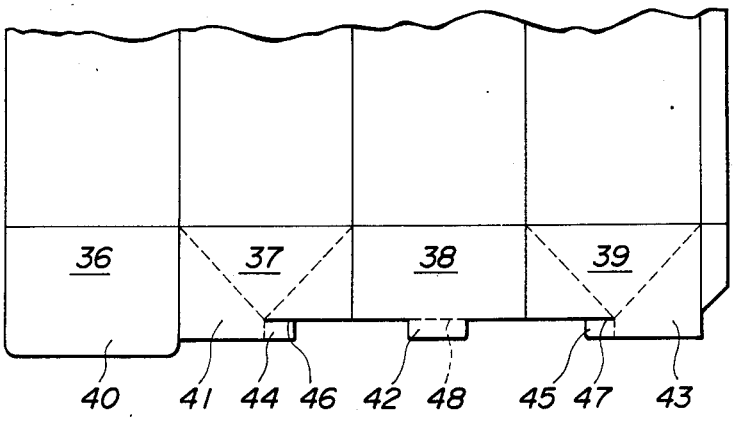
Fig. 4 Prior Art
FIG. 4 is a developed view of the bottom structure of a conventional paper container.

FIG. 3 shows a developed view of a different bottom structure of a paper container according to this invention. Even if the bonding piece 5 is disposed differently in this manner, the same bottom structure can be formed.

According to this invention as described above, less force is applied during assembling and shaping of the flat bottom or top by bending and superposing. Thus, the resistance can be reduced, thereby obtaining a paper container which is properly formed and sealed.

What is claimed is:

1. A flat type top or bottom structure for a paper container having opposed outside bottom plates formed of board paper with thermal adhesive plastic layers on both front and back surfaces, and opposed inside bottom plates with folding lines of isosceles triangular shape, comprising:

a first of said outside bottom plates (6), which is disposed outermost of said bottom plates during assembling and shaping, having a first end piece (10) extending therefrom; and a second of said outside bottom plates (8) having a second tongue-shaped end piece (12) which extends therefrom and which is formed by first and second cutouts from right and left sides of said second outside bottom plate, said second outside bottom plate further including inclined indented edges forming third and fourth cutouts (26, 27) which are respectively adjacent right and left sides of said second tongue-shaped end piece and which are connected at points of their greatest depth by an assembling and folding line (30) connecting said second end piece to said second outide bottom plate;

wherein said inside bottom plates include third and fourth and pieces, respectively extending therefrom and including additional cutouts along 2/5 of the lengths of the third and fourth bottom pieces adjacent the second outside bottom plate, the depth of said additional cutouts being equal to the depth of said first and second cutouts;

further wherein said first end piece extends further from said first outside bottom plate than others of the end pieces (11, 12, 13) extend from others of the bottom plates (7, 8, 9); and further wherein said third and fourth end pieces and said second outside bottom plate are thermally bonded, during assembling and shaping, between an inner surface of said first end piece and an outer surface of said second outside bottom plate.

2. The top or bottom structure for a paper container according to claim 1, wherein said assembling and folding line (30) is thicker than other foldlines.

3. The top or bottom structure for a paper container according to claim 1, wherein said second end piece (12) is of less depth than the end pieces of said inside bottom plates by an amount equal to a depth of said third and fourth cutouts.

4. The top or bottom structure for a paper container according to claim 1, wherein a depth of said third and fourth cutouts corresponds to a thickness of the board paper.

5. The top or bottom structure for a paper container according to claim 1, wherein said third and fourth cutouts are oblique, and have their greatest depth at points of intersection with sides of said second end piece.

* * * * *